156-73.2
10/15/85 OF 4,547,238

United States Patent [19]

Lenders

[11] Patent Number: 4,547,238

[45] Date of Patent: Oct. 15, 1985

[54] METHOD OF MANUFACTURING A SADDLE-SHAPED COIL

[75] Inventor: Wilhelmus L. L. Lenders, Son, Netherlands

[73] Assignee: U.S. Philips Corporation, New York, N.Y.

[21] Appl. No.: 579,245

[22] Filed: Feb. 13, 1984

[30] Foreign Application Priority Data

Feb. 14, 1983 [NL] Netherlands ..... 8300544

[51] Int. Cl.[4] ..... B21F 3/00; B21F 45/00; H01F 27/30

[52] U.S. Cl. ..... 156/73.2; 29/606; 29/33 F; 140/92.2; 140/93 R; 156/166; 156/171; 156/172; 156/275.5; 156/275.7; 242/7.03; 242/7.19; 242/176; 335/213

[58] Field of Search ..... 156/73.2, 166, 169, 156/171, 172, 275.5, 275.7, 574; 264/23; 140/92.2, 115, 122, 71 C, 93 R; 242/1.1 R, 1.1 E, 7.19, 7.03, 176; 29/605, 606, 33 F; 335/213

[56] References Cited

U.S. PATENT DOCUMENTS

| | | | |
|---|---|---|---|
| 804,250 | 11/1905 | Miller | 156/172 |
| 2,368,389 | 1/1945 | Von Knauf | 29/33 F |
| 2,641,301 | 6/1953 | Gerber et al. | 156/172 |
| 3,086,562 | 4/1963 | Price | 140/92.2 |
| 3,634,164 | 1/1972 | Van Hirtum et al. | 156/169 |
| 4,078,301 | 3/1978 | Renders et al. | 29/605 |
| 4,170,505 | 10/1979 | Zgraggen | 156/273.5 |
| 4,244,774 | 1/1981 | Dery | 156/574 |

FOREIGN PATENT DOCUMENTS

| | | | |
|---|---|---|---|
| WO83/01966 | 6/1983 | PCT Int'l Appl. | 156/73.2 |

*Primary Examiner*—Michael Wityshyn
*Attorney, Agent, or Firm*—Thomas A. Briody; William J. Streeter; Leroy Eason

[57] ABSTRACT

In a method of manufacturing a saddle-shaped coil a wire supplied from a winding station is laid in a continuous process by means of a wire guide against a surface of a non-magnetic molding, which surface is concave in a first direction and convex in a direction transverse to the first direction to form a number of continuous turns defining a window, the wire, as soon as it has been laid, being fixed in position instantaneously or substantially instantaneously. In one example the surface of the moulding on which the wire is to be laid and fixed is provided, prior to laying the wire, with a thin layer of contact adhesive and the wire is previously provided with a coating of contact adhesive.

9 Claims, 7 Drawing Figures

METHOD OF MANUFACTURING A SADDLE-SHAPED COIL

BACKGROUND OF THE INVENTION

1. Field of the Invention

The invention relates to a method for manufacturing a saddle-shaped coil and more particularly to a method for manufacturing a saddle-shaped coil for an electromagnetic deflection unit for deflecting the electron beam or beams of electron beam tubes which are used for displaying pictures in television receivers.

2. Background of the Invention

With the advent of picture display tubes having a large maximum deflection angle in the field of television reception, it has become more and more difficult to reproducibly manufacture electromagnetic deflection units which deflect the electron beam or beams of said tubes in the correct manner to provide a commercially acceptable television frame on the associated screen. An electromagnetic deflection unit normally comprises two pairs of deflection coil units. One pair of coil units is used for providing the vertical deflection of the electron beam(s), while the other pair is used for providing the horizontal deflection of the beam(s). Display tubes which require a beam deflection over a large angle, more particularly colour television tubes in which three electron beams are used, require the generation of magnetic fields having an exactly determined configuration both by the pair of horizontal deflection coil units and by the pair of vertical coil units, in order to correctly deflect the electron beam or beams in the tube.

The coil units for the horizontal or line deflection are generally constructed so as to fit around the neck and funnel portions of the cathode-ray-tube and have saddle-shaped windings. The individual coil units are wound automatically on a winding machine. The coil units for the vertical or field deflection may also be of the saddle type, or may be of the toroidal wound type.

Saddle coils are usually wound in a two-part mould (see U.S. Pat. No. 3,086,562). The outer circumference of the aperture in which the wire is to be guided is not situated in one plane but follows an intricate path.

Wing-shaped parts are secured to the two mould halves so as to slide the wire in the aperture. The winding wire is provided with a thermoplastic bonding layer so that, after winding, a self-supporting coil can be obtained by means of heat and pressure.

In order to achieve the wire distribution required for the desired field configuration, as well as reasonable reproducibility of the coils, the utmost care should be paid to, inter alia, the shape of the moulds, the constancy of the outside wire diameter, the thickness of the layer of thermoplastic bonding material, the smoothness of the wire, the softening temperature of the bonding layer, the wire tension during winding, the temperature of the mould during winding, and the winding speed.

Tolerances in the above-mentioned parameters, and also the winding process itself and the uncontrolled sliding of the wire from the wings of the mould during winding, have so far militated against a good reproducibility. This applies particularly in the case of coils which are short compared with their winding height and the active parts (the sides) of which are curved. A good reproducibility is said to exist if in all coils of a series of deflection units each turn with the same sequency number is located in exactly the same position.

It is furthermore known from Japanese Patent Application Laid-Open No. 57-23451 (A) to wind a coil on a coil-former, in which the wire is guided and is fixed in a number of discrete points.

SUMMARY OF THE INVENTION

It is the object of the invention to provide a new method of manufacturing a saddle-shaped coil in which tolerances in one or more of the said parameters no longer play a part in the reproducibility attainable. For that purpose, the method according to the invention is characterized in that a wire which is supplied from a winding station is laid in a continuous process, by means of a wire guide, against a surface of a non-magnetic moulding, which surface is concave in a first direction and convex in a direction transverse to the first direction, to form a number of contiguous turns defining a window, the wire, as soon as it has been laid, being fixed in position instantaneously or substantially instantaneously. The moulding may be adapted to fit around a part of an electron beam tube, or it may be the envelope of an electron beam tube itself.

Laying each wire in its required location can be achieved with the aid of a moulding which is constructed as one half of a mould of the type which is used in the conventional process for winding saddle-shaped deflection coils. As a result of this it is possible to supply the wire parallel to the winding axis and to press it in the correct location by means of a wire guide. This latter can be effected by causing the wire guide to move with respect to the coil support according to a programme previously determined for each turn. It is then important that the fixing of the wire in the location where it has been laid is done instantaneously or substantially instantaneously so that a reasonable winding speed can be achieved. Since the wire is wound against a three-dimensionally shaped (hollow) moulding, in particular a moulding which is adapted to fit accurately around a part of a display tube or which may be the envelope of the display tube itself, and each turn is laid and fixed in position according to a computer programme, the following advantages are obtained:

1. A substantial reproducibility is ensured.
2. The application of heat on the moulding, which is necessary in the usual winding process, is obviated and with it the problem of controlling heat dissipation in a winding mould.
3. Changes in the coil can be carried out rapidly without it being necessary to manufacture or alter moulds for the modified coil but simply by changing the computer programme.

The wire turns can be fixed to the moulding, and to turns already laid thereon, in various ways. A first embodiment is characterized in that prior to winding, the moulding is provided with a thin layer of contact adhesive. Immediately before winding, the winding wire also is provided with a thin layer of contact adhesive, pre-dried by a drying device and laid down and pressed in the desired position on the moulding by means of a wire guide.

An alternative method of fixing the wire is to fix it over the full length by means of a strip of adhesive tape which is so much wider than the wire that the latter is comprised by the adhesive tape. The adhesive tape should be sufficiently deformable to be able to follow the curves of the wire without wrinkling or folding. In this embodiment the winding wire need not be insulated since the adhesive has a sufficiently insulating capacity.

The two above embodiments ensure a rigid bond at the instant the wire and the support contact each other or successive turns contact each other. Hence, these methods do not cause any reduction in the winding speed.

Embodiments which do require some time, albeit a short time, for bonding and hence affect the winding speed are:

ultrasonic welding of a wire clad in a thermoplastic synthetic resin to the molding and to itself;

curing by light (ultraviolet light) of a thin layer of adhesive suitable for that purpose;

melting, followed by cooling ("hot melt"), of either a thermoplastic synthetic resin surrounding the wire or a melting mass provided on the moulding.

In all these cases an electronic control or a computer control may advantageously be used for the programmed control of the wire guide.

A further aspect of the method according to the invention is characterized in that the turns of the coil may be laid in a number of superimposed layers. As a result of the guided laying of the wires the building-up of a coil comprising a number of superimposed layers can in particular be such that each turn of each layer bears on two adjacent turns of the subjacent layer, which leads to a stable assembly.

An embodiment of the method according to the invention will now be described in greater detail with reference to the drawing.

DESCRIPTION OF THE PREFERRED EMBODIMENTS

Figure 1A:
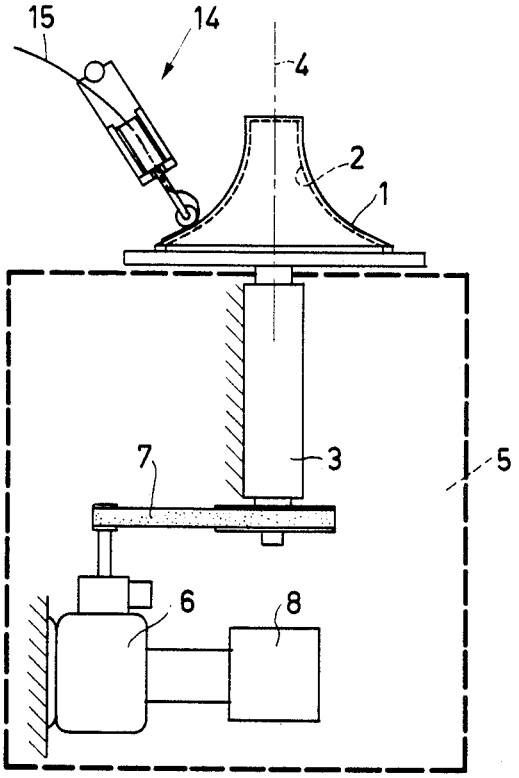
FIG. 1*a* shows diagrammatically an apparatus for winding saddle-shaped coils by means of the method according to the invention.

FIG. 1*a* shows a hollow moulding, or support 1 of a non-magnetic material, in particular a synthetic resin. The moulding is positioned on a mandril 2 which at its end is journalled in a bearing 3 so as to be rotatable about a vertical axis 4. The mandril 2 is connected to a device 5 which comprises an electric motor 6 for turning the mandril 2 to the left or to the right, via a belt 7. The speed of rotation and the direction of rotation of the mandril 2 and hence of the moulding 1 are controlled by means of an electronic control device 8.

Figure 1B:
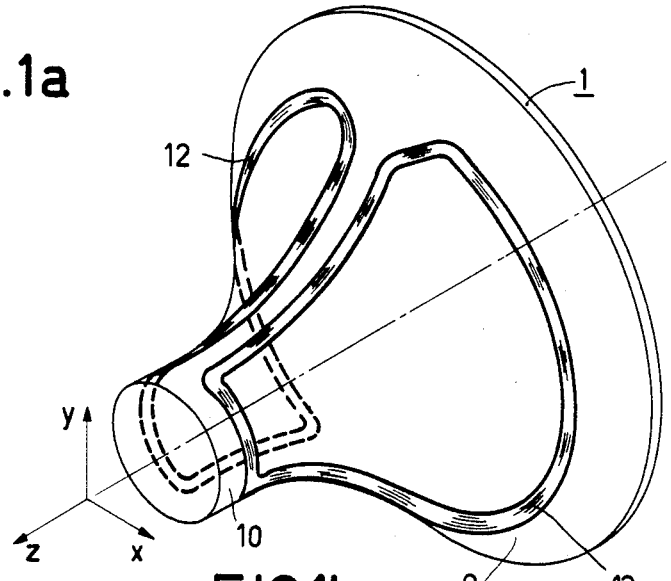
FIG. 1*b* is a perspective view of a hollow moulding having coil units wound against its outer surface.

FIG. 1*b* is a perspective view of the hollow moulding 1. In the present case the moulding 1 is adapted to fit around a part of the envelope of an electron beam tube and for that purpose has a double curvature: at its outer surface the moulding 1 is concave in the axial direction (direction of the z-axis) and convex in a direction transverse to the axial direction to form a support having a cylindrical rear portion 10 and a gradually widening front portion 11. The wire turns of two coil units 12 and 13 are wound and fixed against the outer surface 9 of the moulding 1 by means of a guiding device 14 (FIG. 1*a*). For this purpose, according to an embodiment of the invention, the outer surface 9 of the moulding 1, at least at the places where the wire turns are to be located, is provided with a layer of contact adhesive, for example by spraying, and the wires to be used are themselves also coated with a layer of contact adhesive.

Figure 2A:
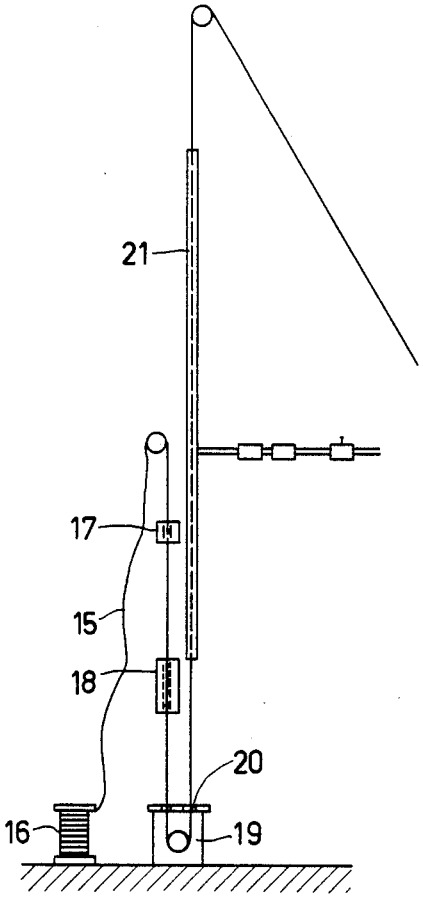
FIG. 2*a* shows a device with which a wire can be coated with a layer of adhesive.
Figure 2B:
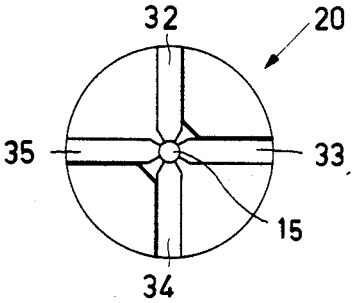
FIG. 2*b* shows a component of the device shown in FIG. 1.

FIG. 2*a* shows a device with which a wire 15 can be coated with a layer of contact adhesive. The wire 15 is supplied from a reel 16. In order to remove contaminants, for example paraffin, the wire 15 is pulled between two pieces of felt 17 which are soaked with a solvent. The clean wire 15 is then passed through a wire tensioning device 18 and then through a container 19 filled with contact adhesive, to provide a concentric layer of adhesive on the wire, excess adhesive being removed from the wire by means of a calibrated aperture 20. The wire 15 is finally passed through a drying station 21, for example a pipe through which hot air is blown. Four members 32, 33, 34 and 35 (FIG. 2*b*) extend radially inwards from the wall of the aperture 20 and have tapering ends which face one another. The members 32–35 are adjustable with respect to the calibrated aperture so that the concentricity of the layer of adhesive which remains around the wire 15 can be accurately controlled. The thickness of the layer of adhesive is determined substantially by the dimension of the calibrated aperture.

Figure 3:
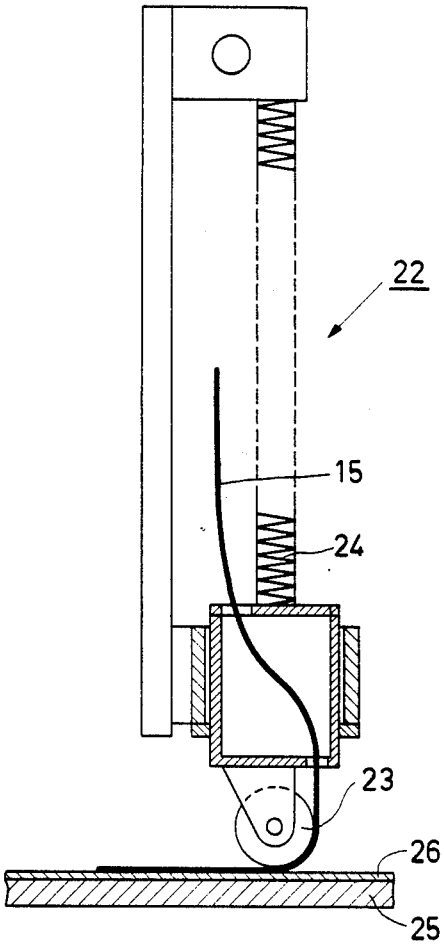
FIG. 3 is a side elevation, partly in section, of a guiding device for laying a wire in turns on a (curved) surface in a controlled manner.

To lay the wire in turns against a surface which is concave in one direction and convex in a direction transverse thereto, for example, the outer surface 9 of the moulding 1 (FIG. 1*b*), the guiding device 22 (the so-called "winding finger") shown in FIG. 3 may be used. An important component of the guiding device 22 is a castor 23 comprising a peripherally grooved wheel around which the wire is guided. A compression spring 24 ensures that the wire 15 is urged against the substrate 25 with a constant force (of, for example, 500 grf). The guiding device 22 can be controlled so that when laying the wire 15 the swivel axis of the castor 23 is always perpendicular to the substrate 25.

The guiding device can be moved with respect to the substrate 25 according to a programme determined individually for each turn. At least three computer-controlled movements are necessary for the winding method according to the invention.

Figure 4:
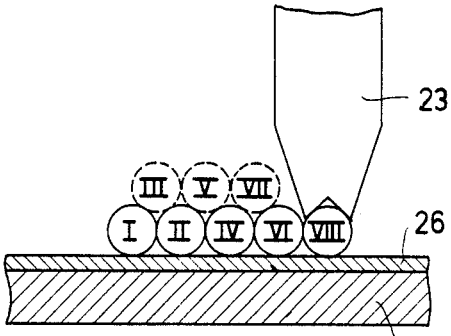
FIG. 4 shows a detail of the device shown in FIG. 3 illustrating the operation of this device.

In the present case a layer of contact adhesive 26 is provided on the substrate 25 to a thickness of, for example, 0.015 mm. This layer is dried prior to laying the wire 15, which itself is coated (as concentrically as possible) with a layer of contact adhesive to a thickness of, for example, 0.01 mm. FIG. 4 shows a number of turns of the wire 15 laid beside and on top of one another in two superimposed layers by means of the castor 23. The winding sequence is denoted by the references I, II, III, IV, V, VI, VII, VIII, but other winding sequences are also possible. By laying the wire turns in a guided manner, a coil comprising a plurality of superimposed layers of turns may be so constructed that each turn of each layer bears on two adjacent turns of the subjacent layer.

The inventive concept of laying the turns of a saddle-shaped coil in a guided manner and fixing the turns as they are laid also enables coils to be obtained having turn distributions which cannot be obtained with conventional winding methods.

With the method according to the invention, either the turns of the coil units of the line coil or the turns of the coil units of the field coil, or the turns of both coil units can be laid and fixed on a moulding in a controlled manner. The turns of the coil units of the field coil may be laid on the same moulding as the turns of the coil units of the line coil, in which case the coil units of the field coil are wound over the line coil but are displaced by 90° about the common axis of the coils with respect to the coil units of the line coil. Alternatively, the field coil may be laid on a second moulding which, after winding, is placed coaxially around a first moulding on which the line coil is laid.

Figure 5:
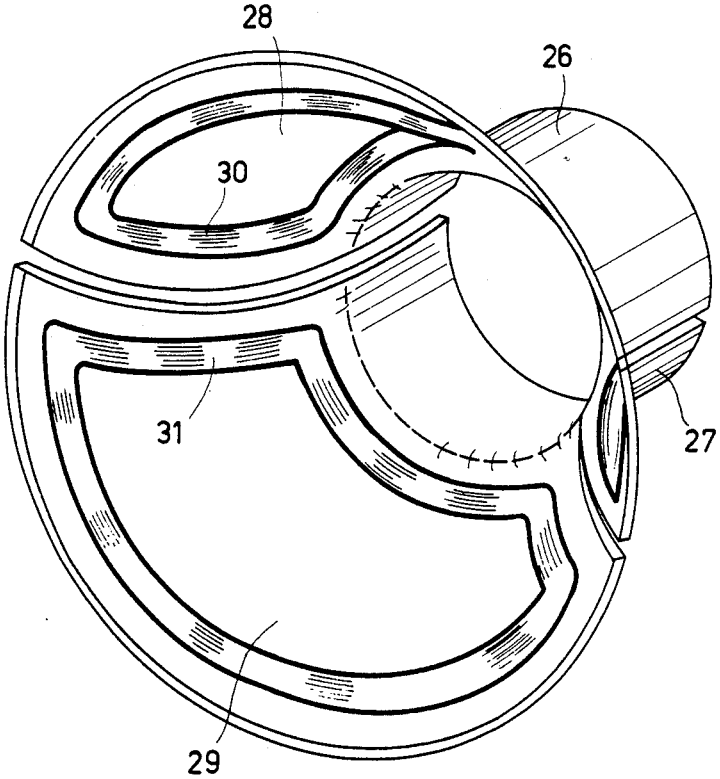
FIG. 5 is a perspective view of two hollow half-mouldings having coil units wound against their inner surfaces.

FIG. 5 shows still another possibility. On the inside of a hollow moulding which in this case consists of two halves 26 and 27, saddle-shaped line coil units 30, 31 are wound and fixed against the respective inner surfaces 28, 29 of the two halves of the moulding. A field coil may then be disposed around the outside of the moulding, for example, by placing a core carrying a torroidally wound field coil coaxially around the moulding or by winding and fixing saddle-shaped field coil units directly on the outer surfaces of the two halves 26, 27 of the moulding.

In another embodiment of the method according to the invention, a layer of synthetic resin having a smooth surface is provided over the line deflection coil and such part of the surface of the moulding as is not occupied by the line deflection coil. A layer of contact adhesive is provided on the layer of synthetic resin, and the turns of the coil units of the second deflection coil are then laid and fixed in a controlled manner on the surface of the synthetic resin layer. This has the advantage that in assembling the deflection unit it is not necessary to align two separate mouldings relative to each other.

What is claimed is:

1. A method for manufacturing a unitary assembly for deflecting an electron beam, such assembly comprising a saddle-shaped coil of wire adhered to the surface of a non-magnetic molding, the surface of such molding being concave in the direction of said beam and convex in a direction transverse to the beam direction, such method comprising:

continuously supplying wire from a winding station;

continuously positioning the wire as it is supplied against the surface of said molding by means of a grooved movable wire guide so as to form a number of contiguous turns defining a window pattern thereon;

and substantially simultaneously adhering the wire to the surface of said molding as it is positioned against such surface.

2. A method as claimed in claim 1 wherein the surface of the moulding on which the wire is to be laid is provided with a layer of contact adhesive prior to laying the wire, and in that the wire is previously provided with a coating of contact adhesive.

3. A method as claimed in claim 1 wherein as soon as the wire has been laid it is fixed in position by a strip of adhesive tape supplied simultaneously with the wire.

4. A method as claimed in claim 3 wherein the wire consists of a non-insulated conductor.

5. A method as claimed in claim 1 wherein the wire is clad in a thermoplastic synthetic resin and, as soon as it has been laid, is fixed in position by an ultrasonic welding process.

6. A method as claimed in claim 1 wherein the wire is covered with a layer of light-curable adhesive, and as soon as the wire has been laid it is fixed in position by exposing the adhesive to light.

7. A method as claimed in claim 1 wherein as soon as the wire has been laid it is fixed in position by a bonding agent which is supplied separately from the wire and which is softened on the moulding by heating and is then allowed to cool.

8. A method as claimed in claim 1 wherein the movement of the wire guide is electronically programme-controlled.

9. A method as claimed in claim 1 wherein the turns of the coil are laid in a number of super-imposed layers which are mutually adherent.

* * * * *